US007823848B2

(12) United States Patent
Haarmann

(10) Patent No.: US 7,823,848 B2
(45) Date of Patent: Nov. 2, 2010

(54) SHELF BASE CARRIER COMPRISING DISTANCING ELEMENTS

(75) Inventor: Wolfram Haarmann, Pfullingen (DE)

(73) Assignee: Element-System Rudolf Bohnacker GmbH, Rottenacker (DE)

( * ) Notice: Subject to any disclaimer, the term of this patent is extended or adjusted under 35 U.S.C. 154(b) by 0 days.

(21) Appl. No.: 12/162,478

(22) PCT Filed: Feb. 16, 2007

(86) PCT No.: PCT/EP2007/051509

§ 371 (c)(1),
(2), (4) Date: Jul. 28, 2008

(87) PCT Pub. No.: WO2007/101776

PCT Pub. Date: Sep. 13, 2007

(65) Prior Publication Data

US 2009/0039222 A1 Feb. 12, 2009

(30) Foreign Application Priority Data

Mar. 3, 2006 (EP) ..... 06110621

(51) Int. Cl.
*A47G 29/02* (2006.01)

(52) U.S. Cl. ..... 248/250; 248/235; 211/135; 108/109

(58) Field of Classification Search ..... 248/235, 248/241, 911, 912, 558, 245, 250; 211/134, 211/135, 148, 153; 108/109, 110, 152, 107
See application file for complete search history.

(56) References Cited

U.S. PATENT DOCUMENTS 2,636,618 A * 4/1953 Merrick ..... 108/152
2,703,692 A 3/1955 Andre
3,429,540 A 2/1969 Worrallo
3,480,155 A 11/1969 Ferdinand et al.
3,574,980 A 4/1971 Keller (Continued)

FOREIGN PATENT DOCUMENTS

DE 2109117 9/1972

(Continued)

*Primary Examiner*—Kimberly T Wood
(74) *Attorney, Agent, or Firm*—Stolowitz Ford Cowger LLP

(57) ABSTRACT

The invention relates to a shelf base carrier which can be suspended or inserted into a vertical wall rail, comprising a lower holding section equipped with a bearing surface for the shelf base which extends from a wall in a horizontal manner on said upper edge, and a clamping element for clamping the shelf base to the rear end which is oriented towards the wall, and which extends above and away from the wall. According to the invention, a lower distancing element can be fixed in a separating manner to the holding section and an upper distancing element can be fixed in a separating manner to the clamping element. The lower and/or the upper distancing elements can be fixed in a first and a second position. In a first position, a first, smaller distance and in the second position, a second larger distance are provided between the bearing surface and/or the lower edge of the clamping element and the contact surface of the respective distancing element is determined by the held shelf base. By combining the first and second positions of the upper and the lower distancing element, the shelf bases can be fixed at various thicknesses, for example, 8 mm, 10 mm and 14 mm.

12 Claims, 6 Drawing Sheets

U.S. PATENT DOCUMENTS

| | | | | | |
|---|---|---|---|---|---|
| 3,604,670 | A | * | 9/1971 | Reeves | 248/250 |
| 3,664,627 | A | | 5/1972 | Sykes et al. | |
| 3,730,468 | A | | 5/1973 | Magnusen | |
| 4,103,855 | A | | 8/1978 | Grosse | |
| 4,156,515 | A | | 5/1979 | Mochly | |
| 4,223,863 | A | | 9/1980 | Birman | |
| 4,274,614 | A | | 6/1981 | Worrallo | |
| 4,299,368 | A | | 11/1981 | Winkler | |
| 4,305,677 | A | | 12/1981 | Kowalski | |
| 4,389,828 | A | | 6/1983 | Cary | |
| 4,421,289 | A | | 12/1983 | Sturm | |
| 4,516,874 | A | | 5/1985 | Yang et al. | |
| 4,537,379 | A | | 8/1985 | Rhoades | |
| 4,646,905 | A | | 3/1987 | Grundken et al. | |
| 4,674,723 | A | | 6/1987 | Bayuk | |
| 4,691,887 | A | * | 9/1987 | Bessinger | 248/250 |
| 4,709,892 | A | * | 12/1987 | Gurgui | 248/250 |
| 4,738,426 | A | * | 4/1988 | Bessinger | 248/250 |
| 4,787,625 | A | * | 11/1988 | Chaloux | 482/87 |
| 4,809,476 | A | | 3/1989 | Satchell | |
| 4,850,172 | A | | 7/1989 | Gailey et al. | |
| 4,934,642 | A | * | 6/1990 | Baron et al. | 248/250 |
| 5,253,835 | A | * | 10/1993 | Herron, III | 248/220.22 |
| 5,318,264 | A | | 6/1994 | Meiste et al. | |
| 5,364,052 | A | | 11/1994 | De Gruttis | |
| 5,388,796 | A | | 2/1995 | Sullivan | |
| 5,692,717 | A | * | 12/1997 | Glaeser | 248/250 |
| 5,775,656 | A | * | 7/1998 | Roberts et al. | 248/250 |
| 6,196,141 | B1 | * | 3/2001 | Herron et al. | 108/108 |
| 6,237,300 | B1 | | 5/2001 | Carne et al. | |
| 6,272,803 | B1 | | 8/2001 | Stachowiak et al. | |
| 6,364,263 | B1 | * | 4/2002 | Ryan | 248/250 |
| 6,412,739 | B1 | * | 7/2002 | Smith | 248/217.2 |
| 6,684,929 | B2 | | 2/2004 | MacDonald et al. | |
| 7,243,887 | B2 | | 7/2007 | Magnusson | |
| 7,392,911 | B2 | | 7/2008 | Stitchick et al. | |
| 2005/0224428 | A1 | | 10/2005 | Weber | |
| 2008/0314850 | A1 | | 12/2008 | Haarmann | |
| 2009/0050592 | A1 | | 2/2009 | Haarmann | |

FOREIGN PATENT DOCUMENTS

| | | | |
|---|---|---|---|
| EP | 95021 | | 11/1983 |
| EP | 0390045 | A | 10/1990 |
| EP | 864273 | | 9/1998 |
| FR | 1466501 | A | 4/1967 |
| FR | 1595521 | | 6/1970 |
| FR | 2319282 | | 2/1977 |
| GB | 294310 | A | 7/1928 |
| GB | 739425 | | 10/1955 |
| GB | 1517532 | | 7/1978 |

* cited by examiner

SHELF BASE CARRIER COMPRISING DISTANCING ELEMENTS

This application is national phase filing of International Application No. PCT/EP2007/051509, filed on Feb. 16, 2007 and claims priority to European Application No. 06110621.7, filed on Mar. 3, 2006, which are incorporated herein in their entirety by reference.

FIELD OF THE INVENTION

The invention relates to a shelf base carrier which can be suspended or inserted into a vertical wall rail of a shelf system or the like.

BACKGROUND OF THE INVENTION

Shelf systems consisting of wall rails and support elements which can be suspended therein for shelf bases are widely used and have become established in private and commercial use, for example for placing books, goods, files and the like over a large surface area. As shelf systems of this type can be extended as desired upward and to the side, they are highly flexible.

Particularly suitable for attaching shelf bases or shelves of differing depth are shelf base carriers with a clamping mechanism, which is provided at the trailing end thereof facing the wall, for clamping the shelf bases. A known shelf base carrier of this type is shown schematically in FIG. 9. The carrier 20 which can be fastened or suspended in a wall rail 10 has a lower holding portion 22 with a bearing surface, which extends at the upper edge thereof horizontally away from a wall 50, for a shelf base 40 and a clamping element 24, extending away above the wall, for clamping the shelf base 40. This allows fastening of shelf bases of differing depth but only of a specific shelf thickness.

Known in the prior art, for example from FR 1 270 138, DE 36 23 000 C2, DE-G-89 06 646, EP-A-0 330 599 and EP-A-0 383 213, are shelf base carriers for clamping shelf bases with screw mechanisms for adapting to various shelf thicknesses. However, screw mechanisms of this type can exert at individual points locally very high forces on the shelf base, thus potentially causing damage thereto. This is highly undesirable, in particular in the case of valuable and/or sensitive shelf bases made of glass, fine wood or natural stone. Also, screw mechanisms of this type are expensive to manufacture and comparatively awkward to handle.

GB 294 310 A describes a shelf base carrier with a lower holding portion and an upper clamping portion, both of which have screwable distancing elements for clamping a shelf.

EP-A-390 045 describes a shelf base carrier with a lower bearing surface and an upper holding surface and also spacer strips which have two grooves arranged perpendicularly to one another and can be attached in a horizontal position onto a first rail and in a vertical position onto a second rail for receiving shelf bases of differing thickness.

SUMMARY OF THE INVENTION

The present invention is therefore based on the object of proposing a shelf base carrier which can be suspended or inserted into a vertical wall rail and allows shelf bases of differing depths and differing shelf thicknesses to be fastened but at the same time can be manufactured cost-effectively and is simple to handle. Damage to the shelf bases or the surface thereof should also be avoided.

To achieve this object, the invention proposes a shelf base carrier which can be suspended or inserted into a vertical wall rail, comprising a lower holding portion with a bearing surface, which extends at the upper edge thereof horizontally away from a wall, for a shelf base and a clamping element, extending away above the wall, for clamping the shelf base at the trailing end thereof facing the wall, having a lower distancing element which can be detachably attached to the holding portion and an upper distancing element which can be detachably attached to the clamping element, wherein the lower and/or upper distancing element can be attached in a first and a second position, in the first position a first, smaller spacing and in the second position a second, larger spacing between the bearing surface or lower edge of the clamping element and the contact surface of the respective distancing element being defined by the held shelf base.

As a result of the removable distancing elements, the shelf base carrier according to the invention allows clamped mounting of shelves of differing depths und thicknesses. Although gradual adaptation to the shelf thicknesses is possible as in a screwable clamping mechanism, the shelf base carrier can be set to specific standard shelf thicknesses as a result of the differing attachment of the distancing elements. As the shelf base carrier according to the invention does not have any movable parts, it is very robust and can be manufactured inexpensively. Also, no strong local forces occur which might damage the surface of the shelf base.

According to one aspect of the invention, the lower distancing element has on one side a flat recess for receiving an upper part of the holding portion in the second position and on the opposing side a deeper recess for receiving an upper part of the holding portion in the first position. Thus, the lower holding element can be set by simple rotation to two different spacings between the bearing surface of the shelf base carrier and the lower side of the shelf base. In this case, the holding portion can be formed by a downwardly tapering U-shaped profile and the lower distancing element can then accordingly have on the opposing sides U-shaped recesses of differing depth.

According to a second aspect of the invention, the upper distancing element has an opening which is not central in the vertical direction and into which the clamping element can be inserted in the first position and, rotated through 180 degrees, in the second position. Thus, the upper holding element can be set by simple rotation to two different spacings between the underside of the clamping element and the upper side of the shelf base. The clamping element can be formed by one or else by two parallel clamping hooks, wherein in the latter case the upper distancing element has two parallel openings which are not central in the vertical direction.

Preferably, the position of the opening in the upper distancing element and the depth of the recess in the lower distancing element are selected in such a way that combining the first and second position of the upper and the lower distancing piece allows fixing of shelf bases of four differing thicknesses, for example 8 mm, 10 mm, 12 mm and 14 mm.

The distancing elements can be made of inexpensive deep-drawn plastics material. The plastics material also substantially prevents damage to the shelf bases which may be made of sensitive material such as glass, fine wood or natural stone.

BRIEF DESCRIPTION OF THE DRAWINGS

The invention will be described hereinafter based on specific exemplary embodiment and with reference to the accompanying drawings, in which.

DETAILED DESCRIPTION OF THE INVENTION

The invention will be described hereinafter in detail with reference to specific exemplary embodiments.

Figure 1:
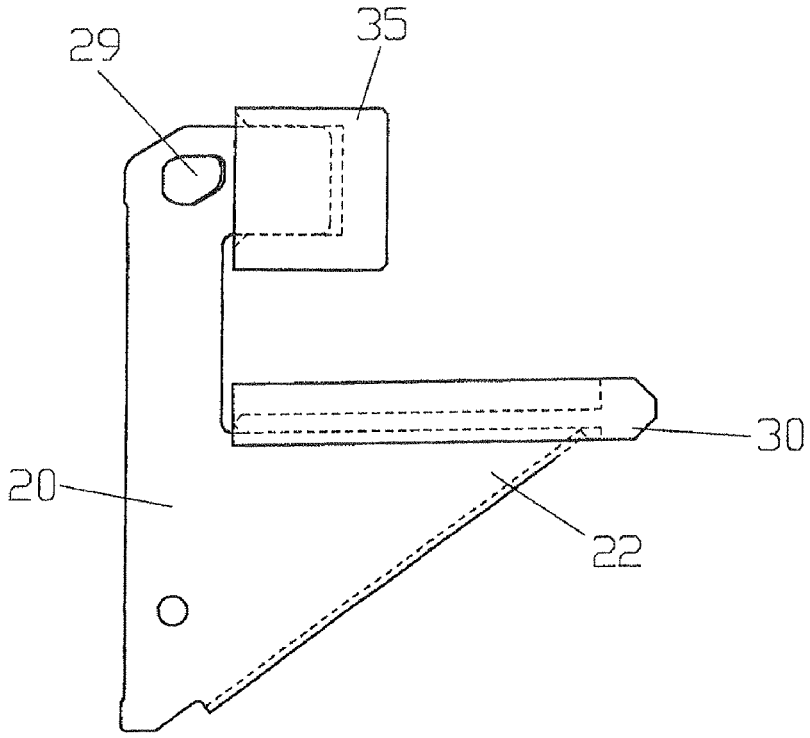
FIGS. 1 and 2 are side views of an exemplary embodiment of the shelf base carrier according to the invention with distancing elements.
Figure 2:
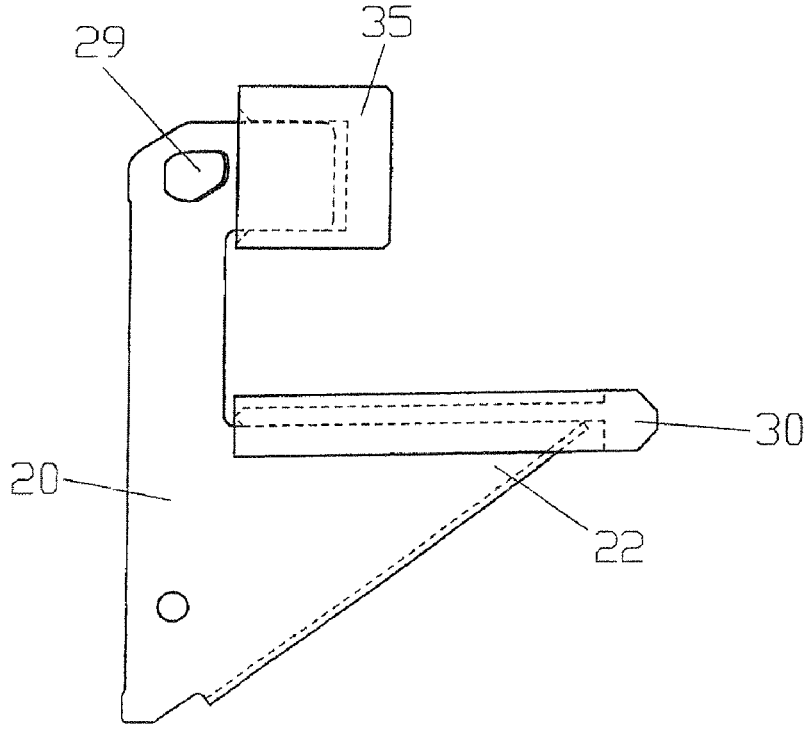
Figure 9:
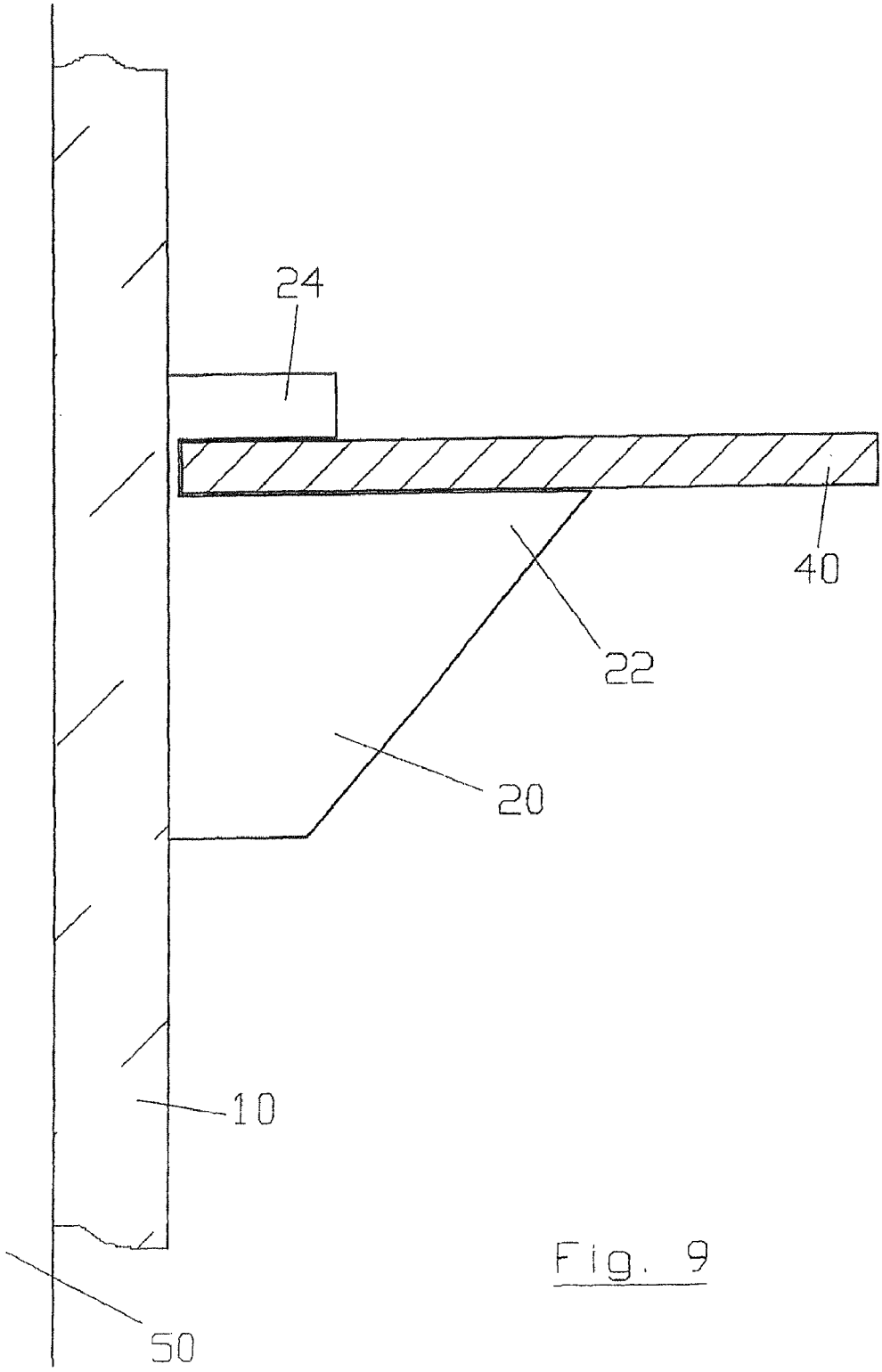
Fig. 9 Prior art
FIG. 9 shows a conventional shelf base carrier.

FIGS. 1 and 2 are side views of an exemplary embodiment of the shelf base carrier 20 according to the invention for clamping a shelf base 40 (see FIG. 9) with distancing elements 30, 35 for adaptation to various shelf base thicknesses. The shelf base carrier 20 has a fastening element 29 (which is illustrated only schematically) for suspension or insertion into a shelf rail 10 (see FIG. 9). Within the scope of the invention, various options for fastening and fixing the shelf base carrier 20 to the wall rail 10 are possible. For the purposes of the present invention, the fastening mechanism is immaterial.

The shelf base carrier 20 has a holding portion 22 forming at the upper edge thereof a bearing surface 23 (see FIGS. 3 and 4) for the shelf base 40. Furthermore, the shelf base carrier or the support element 20 has a clamping element 24 for clamping the shelf base or the shelf between the clamping element 24 and bearing surface 23.

In order to be able to set the shelf base carrier to various shelf thicknesses and also to prevent damage to the shelves, according to the invention a lower distancing element 30 and an upper distancing element 35 are provided. The lower distancing element 30 can be attached to the holding portion 22 and the upper distancing element 35 to the clamping element 24, as is shown in FIGS. 1 and 2. The shelf base is then clamped between the upper distancing element 35 and lower distancing element 30. This allows the upper and the lower distancing element to be attached to the clamping element or to the holding portion in two different positions. The distancing piece increases the spacing between the shelf base carrier and the shelf in the first position by a smaller distance, in the second position by a larger distance. These two positions are shown schematically in FIGS. 1 and 2. The upper distancing piece 35 is located in FIG. 1 in its first position, in which the spacing from the lower edge of the clamping element 24 is increased by a small distance, whereas the upper distancing element 35 is located in FIG. 2 in its second position and increases the spacing from the shelf by a larger distance. Conversely, the lower distancing element 30 is located in FIG. 1 in its second state, which establishes a larger spacing, and in FIG. 2 in the first state, which forms only a smaller spacing distance. Thus, combining the two positions of the upper and lower distancing element allows the shelf base carrier to be adapted to various shelf thicknesses, for example to four different shelf thicknesses such as for example 8 mm, 10 mm, 12 mm and 14 mm.

Figure 3:
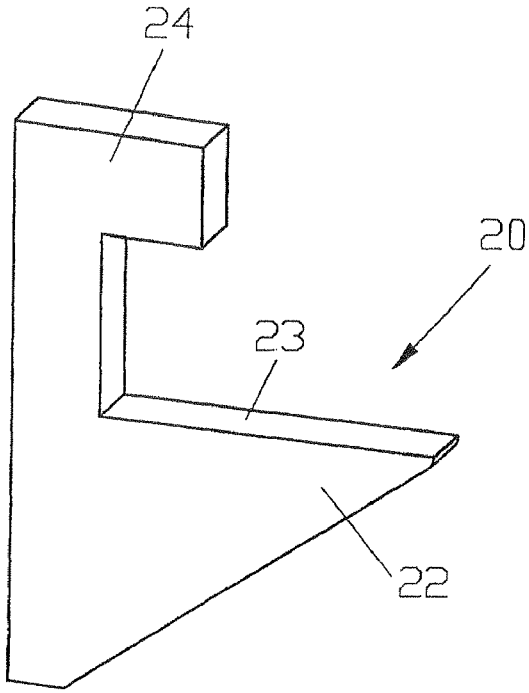
FIG. 3 is a schematic perspective view of a first exemplary embodiment of the shelf base carrier according to the invention.
Figure 4:
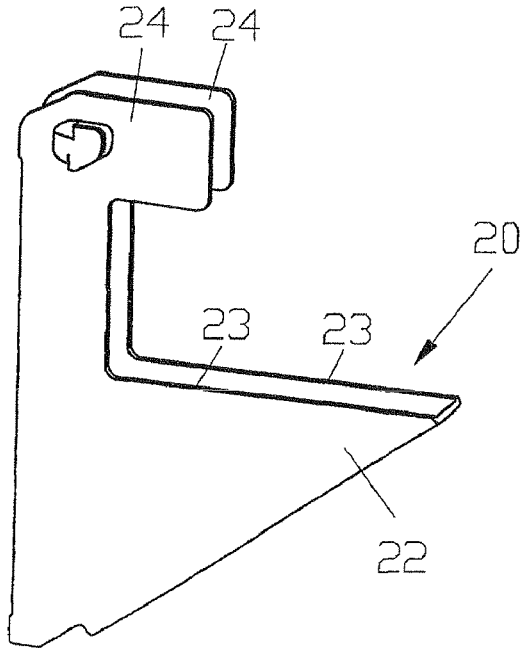
FIG. 4 is a schematic perspective view of a second exemplary embodiment of the shelf base carrier according to the invention.

FIG. 3 shows a first exemplary embodiment and FIG. 4 a second exemplary embodiment of the shelf base carrier according to the invention. The first exemplary embodiment shown in FIG. 3 is overall configured from one piece so as to be "solid", whereas the second exemplary embodiment shown in FIG. 4 is formed of a sheet metal piece and thus has two parallel clamping hooks as the clamping element 24 and also a downwardly tapering U-shaped profile as the holding portion 22.

Figure 5:
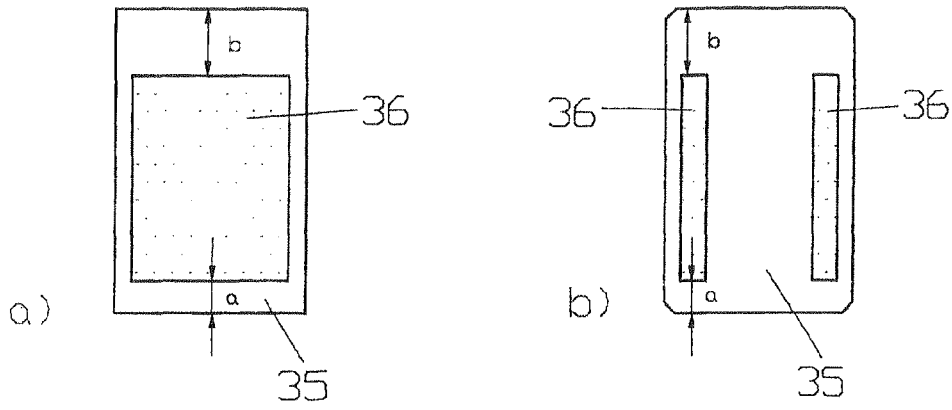
FIG. 5*a*) is a front view of a first exemplary embodiment of the upper distancing element.
FIG. 5*b*) is a front view of a second exemplary embodiment of the upper distancing element.

FIG. 5*a*) shows a first exemplary embodiment of the upper distancing element 35 for use with the shelf base carrier shown in FIG. 3 and FIG. 5*b*) a second exemplary embodiment of the upper distancing element 35 for use with the shelf base carrier shown in FIG. 4, in each case viewed from the front, i.e. looking onto the wall. The upper distancing element 35 shown in FIG. 5*a*) has an opening or recess 36 for receiving at least the front portion of the clamping element 24. The recess 36 is not arranged centrally in the vertical direction. On the contrary, the spacing b between the opening and the upper edge of the distancing element 35 is greater than the spacing a from the lower edge of the distancing element. Similarly, in the second exemplary embodiment shown in FIG. 5*b*), two parallel slots 36 are oriented eccentrically in the vertical direction to receive the two clamping hooks 24 of the shelf base carrier shown in FIG. 4. Detaching, rotating through 180° and reattaching the distancing element 35 allows said distancing element to be brought from its first to its second position and vice versa and the shelf base carrier thus to be set for various shelf thicknesses.

Figure 6:
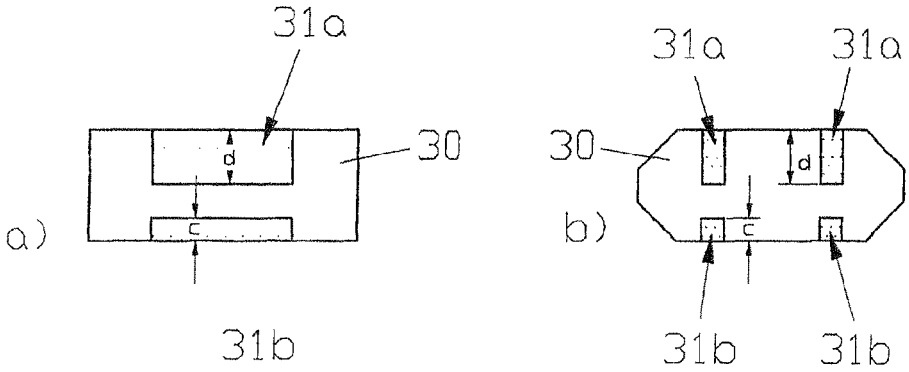
FIG. 6*a*) is a front view of a first exemplary embodiment of the lower distancing element.
FIG. 6*b*) is a front view of a second exemplary embodiment of the lower distancing element.
Figure 7:
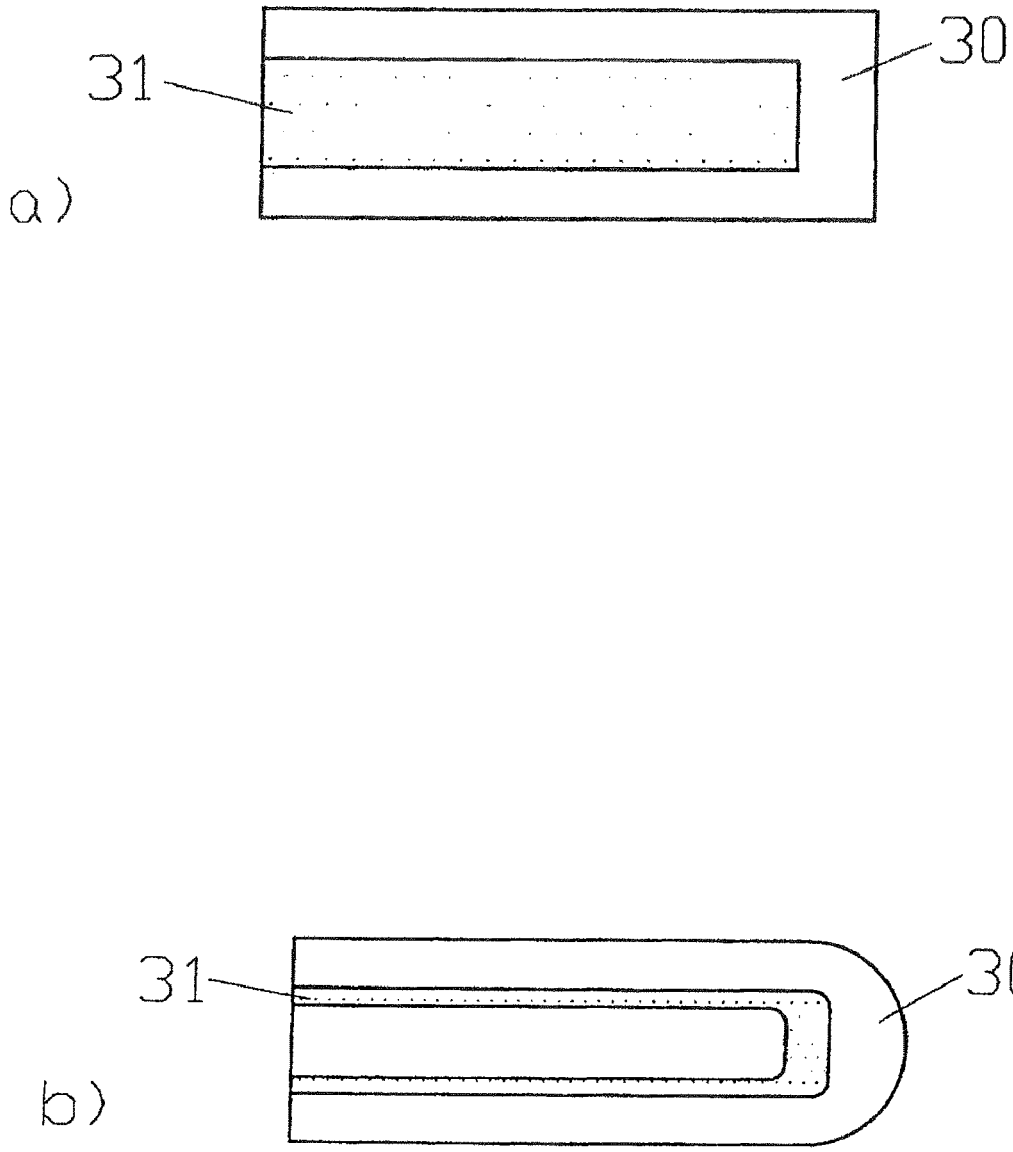
FIG. 7*a*) is a plan view of the first exemplary embodiment of the lower distancing element.
FIG. 7*b*) is a plan view of the second exemplary embodiment of the lower distancing element.

Similarly, the lower distancing element 30 shown in FIGS. 6 and 7 has on its upper side or underside recesses 31*a*, 31*b* of various depths. FIG. 6*a*) shows a first exemplary embodiment of the lower distancing element 30 according to the invention for use with the shelf base carrier shown in FIG. 3 and FIG. 6*b*) a second exemplary embodiment for use with the shelf base carrier shown in FIG. 4. FIGS. 7*a*) and *b*) are plan views of the first and second exemplary embodiment respectively. The rectangular or U-shaped recess 31 configured on the upper side and underside of the lower distancing element 30 may be seen in the figures. The depth of the recess on the two opposing sides of the lower distancing element 30 is, as may be seen from the view of FIGS. 6*a*) and 6*b*), of differing configuration. Whereas the recess 31*b* on the underside has a low depth c, the recess 31*a* on the upper side has a greater depth d.

Figure 8:
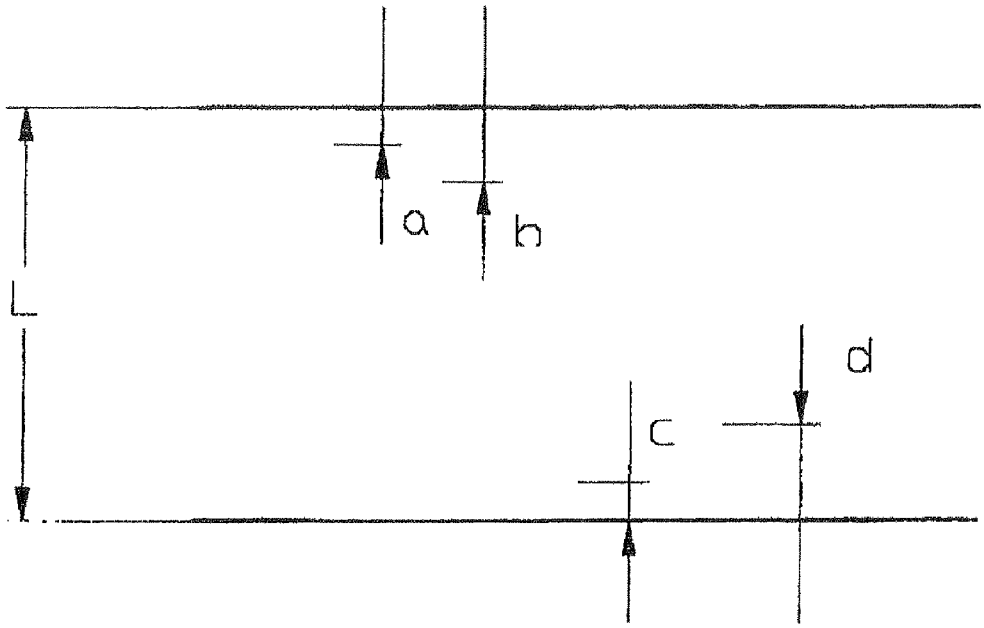
FIG. 8 is a schematic representation to illustrate the various possible shelf thicknesses.

Combining the spacing dimensions a, b, c and d thus allows the shelf base carrier according to the invention to be adapted for various shelf thicknesses. The possible thickness settings are shown schematically in FIG. 8. If the spacing between the lower edge of the clamping element 24 and the bearing surface 23 is L, then the following thickness settings are possible:

i) L-a-c
ii) L-a-d
iii) L-b-c
iv) L-b-d

The distancing elements 30, 35 are preferably made of inexpensive plastics material which is simple to produce such as, for example, deep-drawn plastics material. Other materials are however also possible, wherein care must be taken to ensure that the distancing elements do not cause damage to the surface of the shelf.

The invention thus proposes a shelf base carrier comprising distancing elements that allows clamping of shelves of various depth and for various thickness stages. The shelf base carrier is in this case robust, inexpensive to manufacture and simple to handle. Furthermore, no strong local forces occur, so the shelves can be fixed in a gentle manner.

The invention claimed is:

1. A shelf base carrier which can be suspended or inserted into a vertical wall rail, comprising a lower holding portion with a bearing surface, which extends at a upper edge thereof horizontally away from a wall the bearing surface extending horizontally a first length, for a shelf base and a clamping element, extending away above the wall, for clamping the shelf base at the trailing end thereof facing the wall, having a lower distancing element which can be detachably attached to the lower holding portion and an upper distancing element which can be detachably attached to the clamping element, wherein the lower distancing element can be attached in a first and a second position, in the first position a first, smaller spacing and in the second position a second, larger spacing between the bearing surface of the lower portion and a contact surface of the lower distancing element being defined by the held shelf base, wherein an upper part includes a portion of the bearing surface and at least a portion of each of three contiguous sides of the lower holding portion, the three contiguous sides disposed adjacent to the bearing surface wherein the lower distancing element has a first recess on one side thereof and a second recess on the opposite side thereof, for receiving the upper part of the lower holding portion in the first and second positions, respectively, and wherein a depth of the first recess is larger than a depth of the second recess, both recesses extending, in a position when attached to the upper part of the lower holding portion, in a direction perpendicularly away from the wall.

2. A shelf base carrier configured to be suspended or inserted into a vertical wall rail, comprising a lower holding portion with a bearing surface, which extends at the upper edge thereof horizontally away from a wall, for a shelf base and a clamping element configured to extend away above the wall a first length, for clamping the shelf base at the trailing end thereof facing the wall, having a lower distancing element which can be detachably attached to the lower holding portion and an upper distancing element which can be detachably attached to the clamping element, wherein the upper distancing element can be attached in a first and a second position, in the first position a first, smaller spacing and in the second position a second, larger spacing between the lower edge of the clamping element and a contact surface of the upper distancing element being defined by the held shelf base, wherein the upper distancing element has a cavity enclosed on four sides extending in the vertical direction and being eccentrically located in the vertical direction within the upper distancing element and into which cavity a front end portion of the clamping element can be inserted to mate to the front portion of the clamping element with the upper distancing element in the first position and, rotated through 180 degrees, in the second position;

wherein the cavity when mated to the front portion of the clamping element substantially encases the front end portion of the clamping element.

3. The shelf base carrier according to claim 1, wherein the lower holding portion is formed by a downwardly tapering U-shaped profile and the lower distancing element has on the opposing sides U-shaped recesses of differing depth.

4. The shelf base carrier according to claim 2, wherein the clamping element is formed by two parallel clamping hooks and the upper distancing element has two parallel cavities which are not central in the vertical direction and into which the front portion of the clamping element can be inserted to mate the front portion of the clamping element with the upper distancing element in the first position and, rotated through 180 degrees, in the second position.

5. The shelf base carrier according to claim 1, wherein a first and second position of the cavity in the upper distancing element and the different depths of the first and second recess in the lower distancing element are selected in such a way that combining the first and second position of the upper and the lower distancing piece provides four different spacings between the upper and lower distancing elements.

6. The shelf base carrier according to claim 1, wherein the upper and lower distancing elements are made of deep-drawn plastics material.

7. The shelf base carrier according to claim 1, wherein the upper and lower distancing elements are configured for the mounting of shelf bases made of glass, wood, or stone.

8. The shelf base carrier according to claim 2, wherein a position of the cavity in the upper distancing element and different depths of recesses on opposite sides of the lower distancing element are selected in such a way that combining the first and second position of the upper distancing element and the inverted different depths of the recesses on opposite sides of the lower distancing element provide four different spacings between the upper and lower distancing elements.

9. The shelf base carrier according to claim 1, wherein the first and second recesses of the lower distancing element, when mated with the lower holding portion, cover the upper part of the lower holding portion substantially encasing the upper part a second length equal to at least half of the first length.

10. The shelf base carrier according to claim 1 wherein the first and second recesses extend horizontally along substantially an entire first length of the bearing surface of the lower holding portion.

11. The shelf base carrier according to claim 2 wherein the cavity in the upper distancing element encases the entire front portion of the clamping element, wherein the cavity extends horizontally toward the clamping element a second length equal to at least half of the first length.

12. The shelf base carrier according to claim 2 wherein the cavity in the upper distancing element extends horizontally along substantially an entire first length of the clamping element.

* * * * *